US007264088B2

(12) United States Patent
Spiess et al.

(10) Patent No.: US 7,264,088 B2
(45) Date of Patent: Sep. 4, 2007

(54) DEVICE WITH MOVABLE DOOR SEAL FOR A DISPLACEABLE DOOR OF AN ELEVATOR INSTALLATION AND AN ELEVATOR INSTALLATION WITH SUCH A DEVICE

(75) Inventors: Peter J. Spiess, Meggen (CH); Dario Augugliaro, Lucerne (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 11/468,478

(22) Filed: Aug. 30, 2006

(65) Prior Publication Data

US 2007/0056807 A1 Mar. 15, 2007

Related U.S. Application Data

(62) Division of application No. 10/827,855, filed on Apr. 20, 2004, now abandoned.

(30) Foreign Application Priority Data

Apr. 25, 2003 (EP) ..... 03405293

(51) Int. Cl.
*B66B 13/12* (2006.01)

(52) U.S. Cl. ..... 187/319; 187/330; 187/324; 187/414; 49/120; 49/370; 49/466

(58) Field of Classification Search ..... 187/318, 187/319, 330, 334, 414; 49/120, 370; *B66B 13/02, B66B 13/12, 13/30; E05F 7/06; E06B 3/42, E06B 7/20, 7/215*

See application file for complete search history.

(56) References Cited

U.S. PATENT DOCUMENTS

| | | | |
|---|---|---|---|
| 4,838,385 | A | 6/1989 | Ekholm |
| 5,020,642 | A | 6/1991 | Tsuji |
| 5,719,360 | A | 2/1998 | Davis et al. |
| 5,773,772 | A | 6/1998 | McCarthy et al. |
| 6,871,727 | B2 | 3/2005 | Jokela et al. |
| 2003/0000776 | A1 | 1/2003 | Kostka |
| 2005/0077115 | A1 | 4/2005 | Urata |
| 2005/0087402 | A1 | 4/2005 | Haegi et al. |

FOREIGN PATENT DOCUMENTS

| | | |
|---|---|---|
| EP | 0 891 291 | 1/1999 |

*Primary Examiner*—Patrick Mackey
*Assistant Examiner*—Stefan Kruer
(74) *Attorney, Agent, or Firm*—Fraser Clemens; Martin & Miller LLC; William J. Clemens

(57) ABSTRACT

A device moves a door seal for a displaceable door panel of an elevator car in an elevator installation with an elevator shaft having shaft doors. The movable door seal is arranged so that the door panel in a closed state is sealed off. The device includes an entrainer unit connected with the door panel and upon stopping of the elevator car at a floor executes a part movement. The device also includes a coupling mechanism mechanically connecting the entrainer unit with the door seal to bring the door seal out of a sealing position into an open position when the entrainer unit executes the part movement.

11 Claims, 7 Drawing Sheets

DEVICE WITH MOVABLE DOOR SEAL FOR A DISPLACEABLE DOOR OF AN ELEVATOR INSTALLATION AND AN ELEVATOR INSTALLATION WITH SUCH A DEVICE

CROSS-REFERENCE TO RELATED APPLICATIONS

This application is a divisional application of the U.S. patent application Ser. No. 10/827,855 filed Apr. 20, 2004 now abandoned, which is hereby incorporated herein by reference.

BACKGROUND OF THE INVENTION

The present invention relates to a device with a movable door seal for a displaceable door panel of an elevator installation and an elevator installation with such a device.

Conventional elevator installations comprise an elevator car, which moves vertically upwardly and downwardly in an elevator shaft and can usually move to several floors. The elevator shaft has shaft doors with at least one horizontally displaceable shaft door panel. A car door with at least one horizontally displaceable car door panel is disposed at the elevator car. The car door moves together with the elevator car in the shaft. In each instance one of the shaft doors and the car doors may open automatically only if the elevator car reaches a floor which it is moving to. The shaft doors of all other floors in that case must remain closed. The elevator installation therefore comprises a coupling device by way of which an unlocking mechanism of the shaft doors and the car doors are so coupled that during normal operation of the elevator installation the shaft doors of a floor and the car doors open only when the elevator car stops in the region of the corresponding floor. On opening, the shaft door is driven by the car doors, wherein the shaft door panel and the car door panel open virtually simultaneously.

An elevator installation described in European Patent Specification EP 0 332 841 B1 comprises a coupling device which so couples the shaft doors with the car door that an unlocking of the shaft doors by the car doors is possible. Each shaft door panel has two shaft door panel entraining rollers, termed shaft door rollers in the following. The shaft door rollers are so constructed and arranged that the shaft door rollers together with a shaft door panel are displaceable against a closing force transversely to the travel direction of the elevator car. Moreover, there is associated with the elevator car for each car door panel an entrainer unit that substantially comprises two symmetrically arranged runner units which extend in the travel direction of the elevator car. The runner units are displaceable transversely to the travel direction. They lie closely beside one another and do not contact the shaft door rollers when the elevator car is disposed in travel and moves past the shaft doors of the different floors. If the elevator car reaches a floor to be moved to, then the runner units are separated from one another transversely to the travel direction of the elevator car and pass into the region of contact of the shaft door rollers. The runner units execute a part movement which is employed, for example, to mechanically unlock the car door panel. Unlocking of the shaft door panels can also be effected by this part movement. After the unlocking, the runner units execute a common horizontal movement which is here termed opening movement. Through this opening movement the car door panels open the panels of the shaft doors.

Details of such an entrainer unit with runners are shown in the European Patent Application EP 02 405 810.9, which was filed on Sep. 18, 2002 and bears the title "Kopplungssystem zum Entriegeln eines Schachttürflügels und eines Kabinentürflügels".

Door gaps, which have to be sealed off by sealing lips or the like, result between the car door panels and the elevator car as well as between the shaft door panels and the shaft door frame. It is a disadvantage of these sealing lips that they rub along a sealing surface during the opening and closing of the door panels. This rubbing leads firstly to a wear of the sealing lips and secondly disruptive noises can be caused by the rubbing. Worn sealing lips no longer satisfactorily fulfil their sealing function. As a result, disturbing air currents in the elevator car or in the shaft door region can arise particularly in the case of high performance elevators which move very rapidly. Moreover, disturbing noises can penetrate into the elevator car.

High pressure differences, which necessitate an intact sealing system, arise particularly with high performance elevators.

In the case of fire, passengers of an elevator can be put at risk by smoke gases. Accordingly, the door seals at the shaft doors have to be so designed that they delay or even prevent penetration of conflagration gases into the elevator shaft.

A sealing system for a car door is described in European Patent EP 616 970 B1. There an elevator car is proposed, the car door panels of which are guided along a rail which has inclined sealing surfaces. Each car door panel is provided with an angle profile member which also has an inclined surface. If the car door panels are closed, then the inclined surfaces of the angle profile members approach the inclined sealing surfaces. If the car door panels are closed, then these surfaces lie on one another and serve as a seal. This arrangement is costly. A rubbing of the surfaces cannot, however, be prevented by this solution.

Another form of sealing system is shown in the U.S. Pat. No. 4,058,191. In this patent, an elevator installation is described which has a movable seal between the elevator car and the elevator shaft. Thus, at standstill of the elevator car at the level of a floor, disturbing air currents in the door region are reduced. According to this patent a seal of the elevator car is mechanically pressed against the shaft wall on opening of the car doors.

A sealing system for sealing the elevator car is described in the U.S. Pat. No. 4,735,293. This system is based on the fact that pressure seals are brought into a sealing position when the car door panels close. For this purpose, the car door panels carry movable seals, which on closing of the panels run against a mechanical abutment and are thereby moved into the sealing position. In that case a horizontal sliding movement of the car door panels is converted into a vertical sliding movement of the seals. On closing of the car door panels there also results in the case of this solution a rubbing movement between the seals and a sealing surface at the elevator car.

SUMMARY OF THE INVENTION

It is therefore the object of the present invention to create an improved elevator door sealing system which avoids the disadvantages of the state of the art devices and allows a reliable sealing in the region of the shaft doors or a reliable sealing of the elevator car in the region of the car doors.

The following advantages, in particular, are achieved by the present invention:

The door seals can be moved away from the associated sealing surfaces shortly before opening of the door panels in order to completely avoid rubbing of the seals.

The seals can be better optimized, since they are loaded—depending on the respective use—only, for example, in compression.

The seals can be so shaped and arranged that they engage in a counter member in order to thus achieve an even better sealing.

The elevator shaft can be better screened and for a longer period of time against smoke and conflagration gases.

The disruptive influence of the chimney effect of the elevator shaft can be reduced by use of the sealing device according to the invention at the shaft doors.

Disturbing noises (rattling noises of the sealing mechanism, rubbing noises of the seals) can be better suppressed or even avoided.

Through the lifting off or movement away of the seals, the friction during opening and closing of the door panels is reduced by comparison with doors with conventional seals. Lower forces are thereby needed for the opening and closing.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
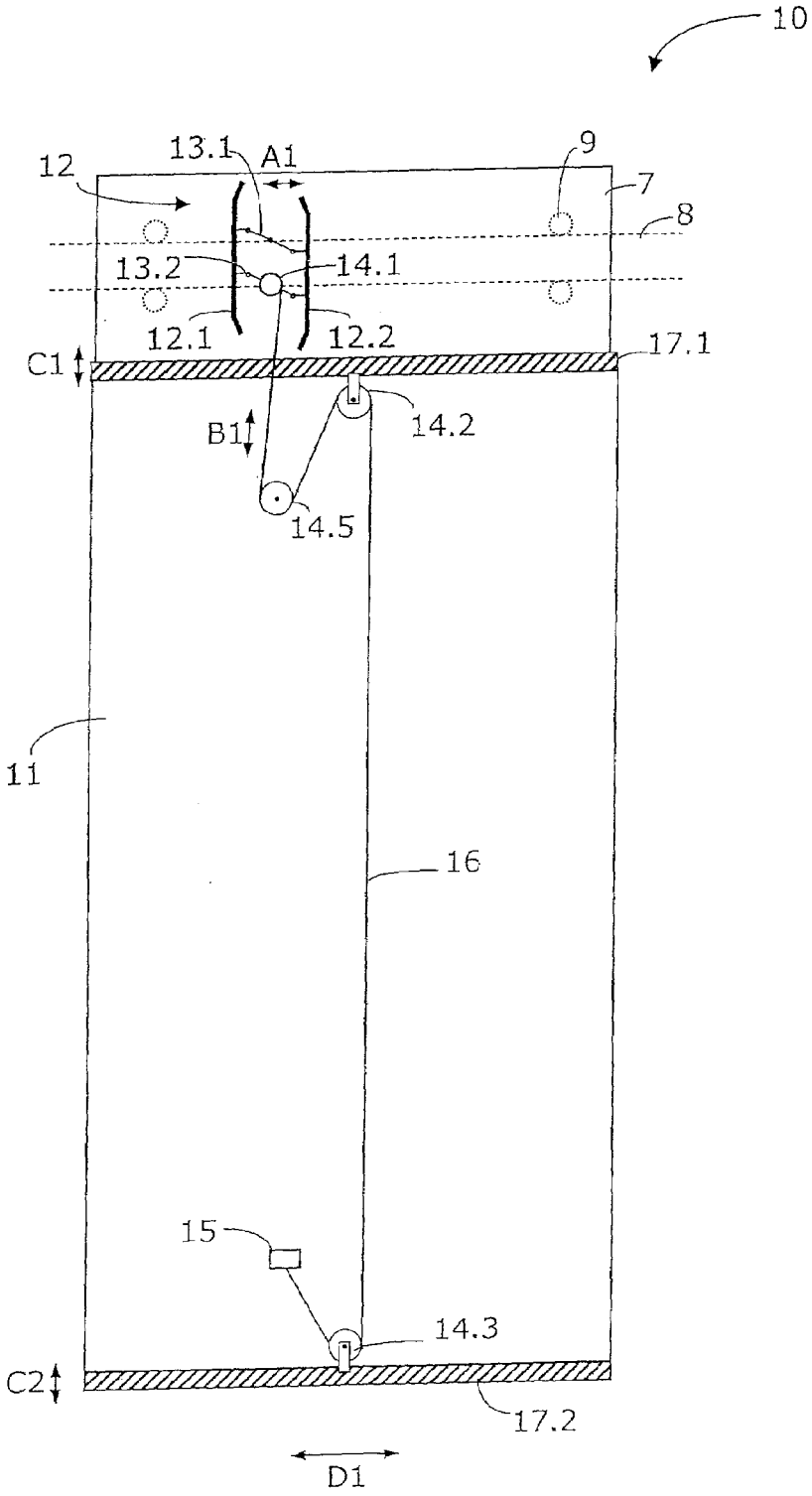
FIG. 1 is a schematic side elevation view showing a car door panel, according to the present invention, which comprises an entrainer unit, a first coupling mechanism constructed in the manner of a cable pull and two movable seals.

Constructional elements which are identical or act in the same manner are provided in all figures with the same reference numerals even when they are not identically constructed in detail. The figures are not to scale.

FIG. 1 shows a first device 10 according to the invention in a schematic side view. The device 10 comprises two movable door seals 17.1, 17.2, which are carried by a slidable door panel 11. The device 10 is a component of an elevator car (not shown) which is part of an elevator installation (not shown) with an elevator shaft (not shown) and shaft doors (not shown). The door panel 11 has a carriage which comprises a plate 7 with rollers 9. This carriage moves along a rail 8 which is mechanically fastened to the elevator car. This suspension enables a horizontal opening and closing motion indicated by an arrow D1 of the car door panel 11. The movable door seals 17.1, 17.2 are so arranged that the door panel 11 in the closed state is sealed off with respect to a sealing surface at the elevator car (not shown in FIG. 1) by the door seals 17.1, 17.2 at least in a region. The device 10 comprises an entrainer unit 12 which is fastened to the plate 7 of the door panel 11. This entrainer unit 12 has, for example, two runners 12.1 and 12.2 which extend parallel to one another and are connected together by way of a lever system 13.1, 13.2. On stopping of the elevator car at the level of a floor and before opening of the door panel 11, the entrainer unit 12 makes a first (spreading) movement. This movement is here termed part movement indicated by an arrow A1. The part movement is produced by a rotation of the lever of the lever system 13.1, 13.2, which is moved by a car door drive (not shown) or a drive unit (not shown) specially present for that purpose.

According to the present invention, the device 10 comprises a coupling mechanism which mechanically connects the entrainer unit 12 with the door seals 17.1, 17.2. In the first example, the embodiment of the coupling mechanism is a mechanism which is constructed in the manner of a cable pull and which is connected by way of a roller 14.1 or a lever with the lever system 13.1, 13.2. Fastened to the roller 14.1 is a cable 16 which, caused by the part movement A1, executes a movement indicated by an arrow B2. The cable 16 is guided by way of a first deflecting roller 14.5, a second deflecting roller 14.2 and a third deflecting roller 14.3. The cable 16 is connected with the door panel 11 at the cable end 15. The roller 14.2 is mechanically connected with the upper door seal 17.1 and the roller 14.3 is mechanically connected with the lower door seal 17.2. On movement of the runners 12.1, 12.2 apart (part movement A1) the cable 16 is pulled. The upper seal 17.1 thereby moves downwardly and the lower seal 17.2 upwardly. The movement of each of the seals 17.1, 17.2 is indicated by the arrows C1, C2 respectively. The two seals 17.1, 17.2 execute translational movements. The seals 17.1, 17.2 are appropriately mounted and guided in order to permit a translational movement. Parallel sliding guides are, for example, suitable for guidance of the seals 17.1, 17.2.

Through the pulling at the cable 16 the door seals 17.1, 17.2 are brought out of a sealing position into an open position as soon as the entrainer unit 12 executes the part movement (A1). The door panel 11 can now be opened by the sliding movement D1.

In the course of the part movement A1 the runners 12.1, 12.2 are moved so far apart that they come into the contact region of shaft door rollers, move the shaft door rollers which are displaceably fastened to the shaft door panels, and thus unlock the shaft door panels.

Figure 2:
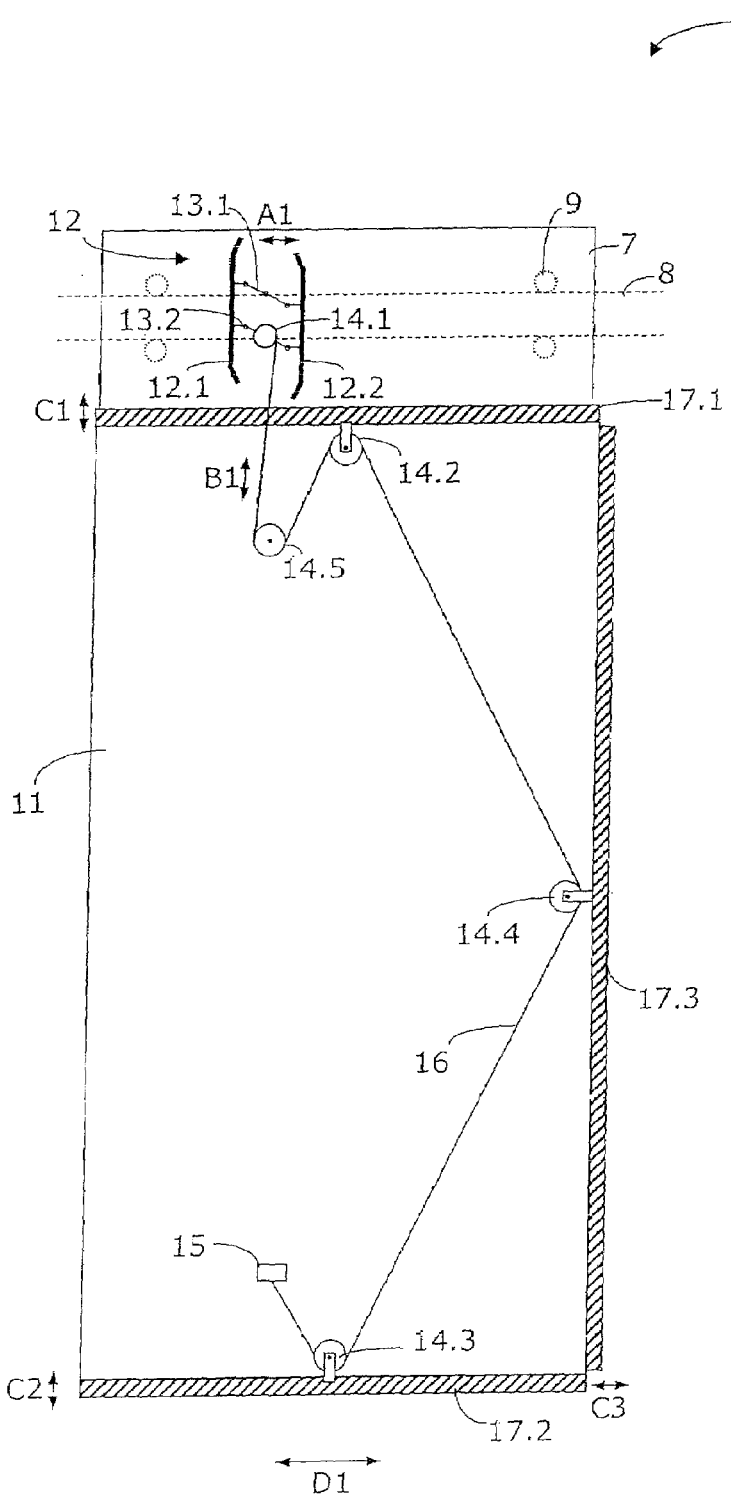
FIG. 2 is a schematic side elevation view showing a car door panel, according to a second embodiment of the present invention, which comprises an entrainer unit, a second coupling mechanism constructed in the manner of a cable pull and three movable seals.

FIG. 2 shows a second device 20 according to the invention in a schematic side view. The device 20 comprises three movable door seals 17.1, 17.2 and 17.3, which are carried by the horizontally slidable door panel 11. The movable door seals 17.1, 17.2 and 17.3 are so arranged that the door panel 11 in the closed state is sealed off with respect to corresponding sealing surfaces (not shown in FIG. 2) at the elevator car by the door seals 17.1. 17.2 and 17.3 at least in a region. The device 20 comprises the entrainer unit 12, which is fastened above the door panel 11 to the plate 7. This entrainer unit 12 comprises, for example, the two runners 12.1 and 12.2 which extend parallel to one another and are connected by way of the lever system 13.1, 13.2. On stopping of the elevator car at the level of a floor and before opening of the door leaf 11 the entrainer unit 12 makes a first (spreading) movement. This movement is here termed the part movement A1. The part movement is produced by a rotation of the lever of the lever system 13.1, 13.2, which is moved by a car door drive or a drive unit specially present for that purpose.

According to the present invention the device 20 comprises a coupling mechanism which mechanically connects the entraining unit 12 of the door seal 17.1, 17.2 and 17.3. In the second example of embodiment the coupling mechanism is, as also in FIG. 1, a mechanism constructed in the manner of a cable pull, which is connected by way of the roller 14.1 or a lever with the lever system 13.1, 13.2. The cable 16 is fastened to the roller 14.1 and executes, caused by the part movement A1, the movement B1. The cable 16 is guided by way of the first deflecting roller 14.5, the second deflecting roller 14.2, a third deflecting roller 14.4 and the fourth deflecting roller 14.3. The cable 16 is connected at the cable end 15 with the door panel 11. The roller 14.2 is mechanically connected with the upper door seal 17.1, the roller 14.4 with the lateral door seal 17.3 and the roller 14.3 with the lower door seal 17.2. On movement apart (part movement A1) of the runners 12.1, 12.2, the cable 16 is pulled. The upper seal 17.1 thereby moves downwardly, the lateral seal 17.3 to the left and the lower seal 17.2 upwardly. The movement of the seals 17.1, 17.2 and 17.3 is indicated by the arrows C1, C2 and an arrow C3 respectively. All three seals 17.1, 17.2 and 17.3 execute translational movements. The seals 17.1, 17.2 and 17.3 are appropriately mounted and guided in order to permit a translational movement. Parallel sliding guides are, for example, suitable for guidance of the seals 17.1, 17.2, 17.3.

Figure 3A:
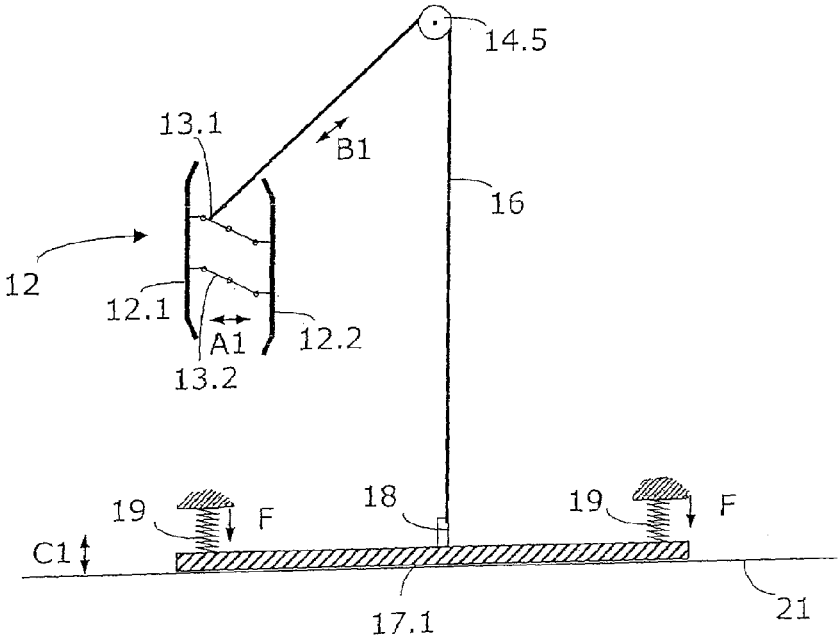
FIG. 3A is a schematic side elevation view showing a third coupling mechanism with a movable seal, according to the present invention, wherein the seal is disposed in a sealing position.
Figure 3B:
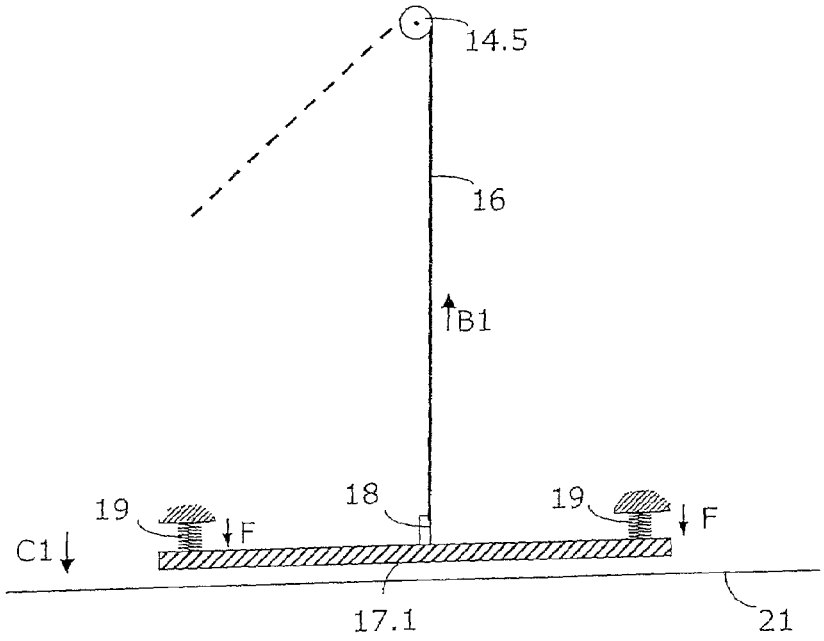
FIG. 3B shows the third coupling mechanism of FIG. 3A, wherein the seal is disposed in an open position.

A detail of a third form of embodiment of the present invention is indicated in FIGS. 3A and 3B. This device, too, comprises the entrainer unit 12 with the two runners 12.1 and 12.2 and the lever system 13.1, 13.2. There is provided a coupling mechanism, which mechanically connects the entrainer unit 12 with a door seal 17.1. The coupling mechanism is constructed in the manner of a cable pull and is directly connected with the lever 13.1 of the lever system. This connection is provided outside the fulcrum of the lever 13.1. In order to ensure that the cable 16 runs perpendicularly towards the seal 17.1, the deflecting roller 14.5 was fastened to the door panel (not shown). The cable end is fastened to a fastening element 18. The fastening element 18 is connected with the seal 17.1. It is ensured by such an arrangement that a tension force in the direction of the arrow B1 acts by way of the cable 16 on the seal 17.1, which extends parallel to the direction C1 of displacement of the seal 17.1. The movable door seal 17.1 has two restoring elements 19 which can comprise, for example, springs. Each of the springs 19 presses the seal 17.1 by a force F against a sealing surface 21, which is indicated in FIG. 3A as lines. In FIG. 3A the seal 17.1 is disposed in the sealing position. The air gap between the door panel and the sealing surface 21 is closed by the seal 17.1. FIG. 3B shows a detail of FIG. 3A. The cable 16 pulls on the seal 17.1 by a force in the direction of the arrow B1 and thereby brings it into an open position. The force in the direction B1 is at least twice as large as the force in the direction F. If the seal 17.1 is disposed in the open position, the springs 19 are compressed and a small spacing (air gap) exists between the sealing surface 21 and the seal 17.1.

Figure 4:
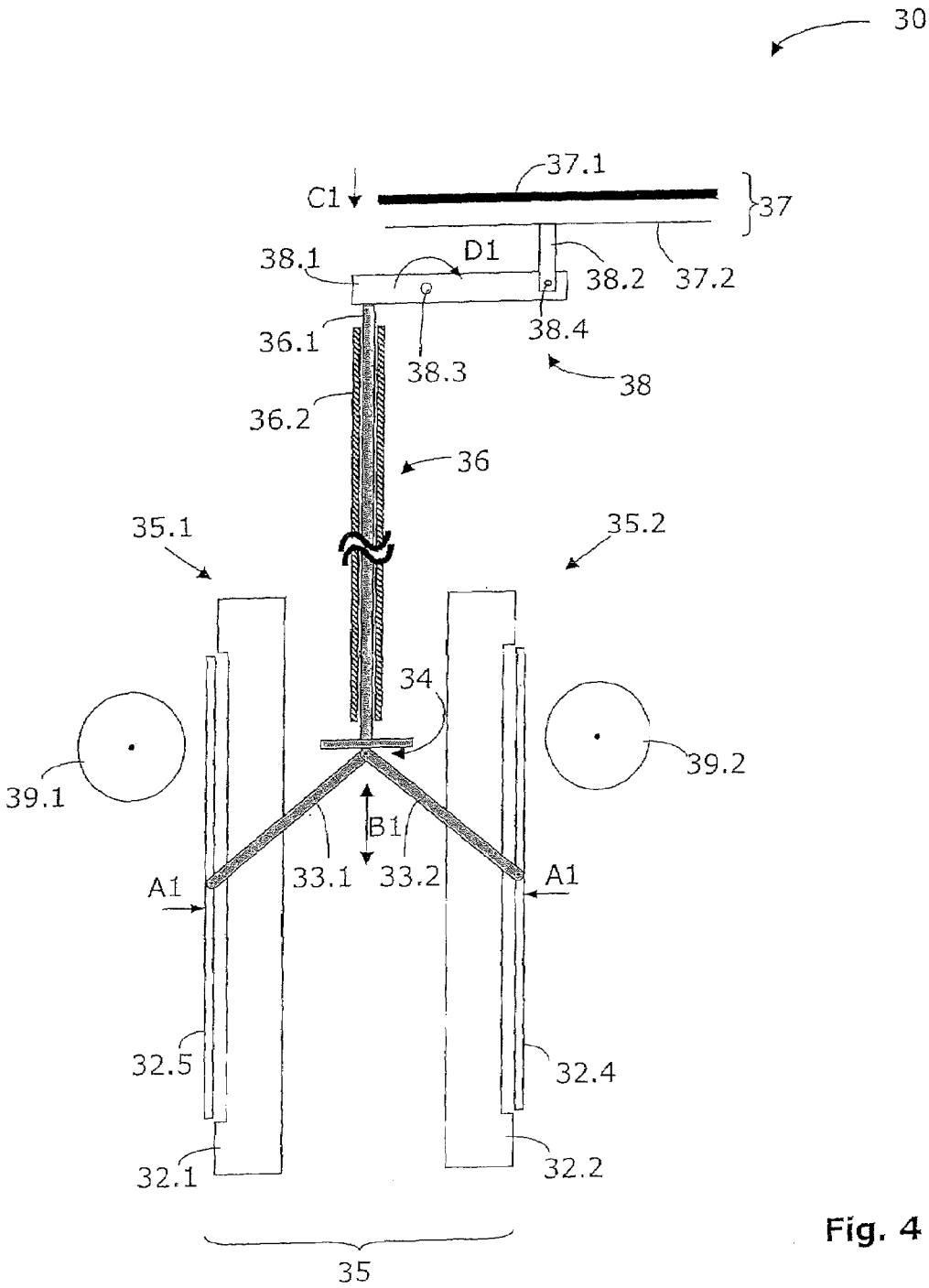
FIG. 4 is a schematic elevation view showing a fourth coupling mechanism with a movable seal according to the present invention.

A fourth device 30 according to the present invention is shown in FIG. 4. FIG. 4 shows the device 30 in a schematic side view. The device 30 comprises a movable door seal 37 which is carried by a slidable door panel (not shown). The door seal 37 comprises a seal carrier 37.2 which carries a sealing profile 37.1. The door seal 37 is so arranged that the door panel in closed state is sealed off with respect to a sealing surface at the housing of the elevator car (not shown in FIG. 1) by the door seal at least in a region. The device 30 comprises an entrainer unit 35 which is fastened above the door panel to the plate of a carriage carrying the door panel. It is to be noted that the arrangement of the door seal 37 with respect to the entrainer unit 35 is shown in strongly schematic form in order to be able to more simply illustrate the principle of operation. The entrainer unit 35 comprises, for example, two runners 35.1 and 35.2 which extend parallel to one another. A scanning runner 32.4 or 32.5 is integrated in each of the runners 35.1 and 35.2, respectively. The runners 35.1 and 35.2 execute, driven by a car door drive or a drive unit specially present (not shown) for that purpose, a (spreading) movement. The scanning runners 32.4, 32.5 are thereby brought into contact with shaft door rollers 39.1 and 39.2. These shaft door rollers 39.1 and 39.2 are connected with shaft door panels and exert a counter-force on the scanning runners 32.4, 32.5. The scanning runners 32.4, 32.5 are urged by this counter-force slightly into the runners 32.1 and 32.2. The movement of the scanning runners 32.4, 32.5 is here termed the part movement A1. The scanning runners 32.4, 32.5 are connected with a lever system 33.1, 33.2 which converts the part movement A1 into the raising/lowering movement B1 of a region 34. Details of such an entrainer unit with runners and scanning runners are shown in the European patent application entitled "Kopplungssystem zum Entriegeln eines Schachttürflügels und eines Kabinentürflügels", EP 02405810.9, described above.

There is provided a coupling mechanism which mechanically connects the entrainer unit 35 with the door seal 37. The coupling mechanism is constructed as a Bowden pull 36, wherein a tension force can be exerted on the door seal 37 by way of the Bowden pull 36 and a lever mechanism 38. For the sake of simplicity the Bowden pull 36 is illustrated as a straight element which transmits a pressure force. In reality, the Bowden pull 36 is flexible and can transmit compression and tension forces as well as be laid along a curved path. In the illustrated form of embodiment the Bowden pull 36 comprises a flexible casing 36.2 and a flexible, elongate element 36.1. The elongate element 36.1 can be moved upwardly and downwardly without the casing 36.2 displacing. There is provided the lever mechanism 38 which has two lever elements 38.1 and 38.2. The lever 38.1 is mounted to be rotatable about an axle 38.3. The lever element 38.2 is movably connected with the lever element 38.1 by way of an axle 38.4.

The coupling mechanism functions as follows. If the runners 32.5 and 32.4 execute the part movement A1, which is oriented towards one another, the point 34 rises. The elongate element 36.1 is thereby displaced upwardly and the lever element 38.1 is raised at the lefthand side. This rotational movement of the lever element 38.1 is denoted by the arrow D1. The righthand side of the lever element 38.1 is lowered and thereby draws the lever element 38.2 downwardly. Since the lever element 38.2 is connected with the seal carrier 37.2, the entire seal 37 is thereby moved downwardly. The seal 37 is thus brought into the open position.

Figure 5:
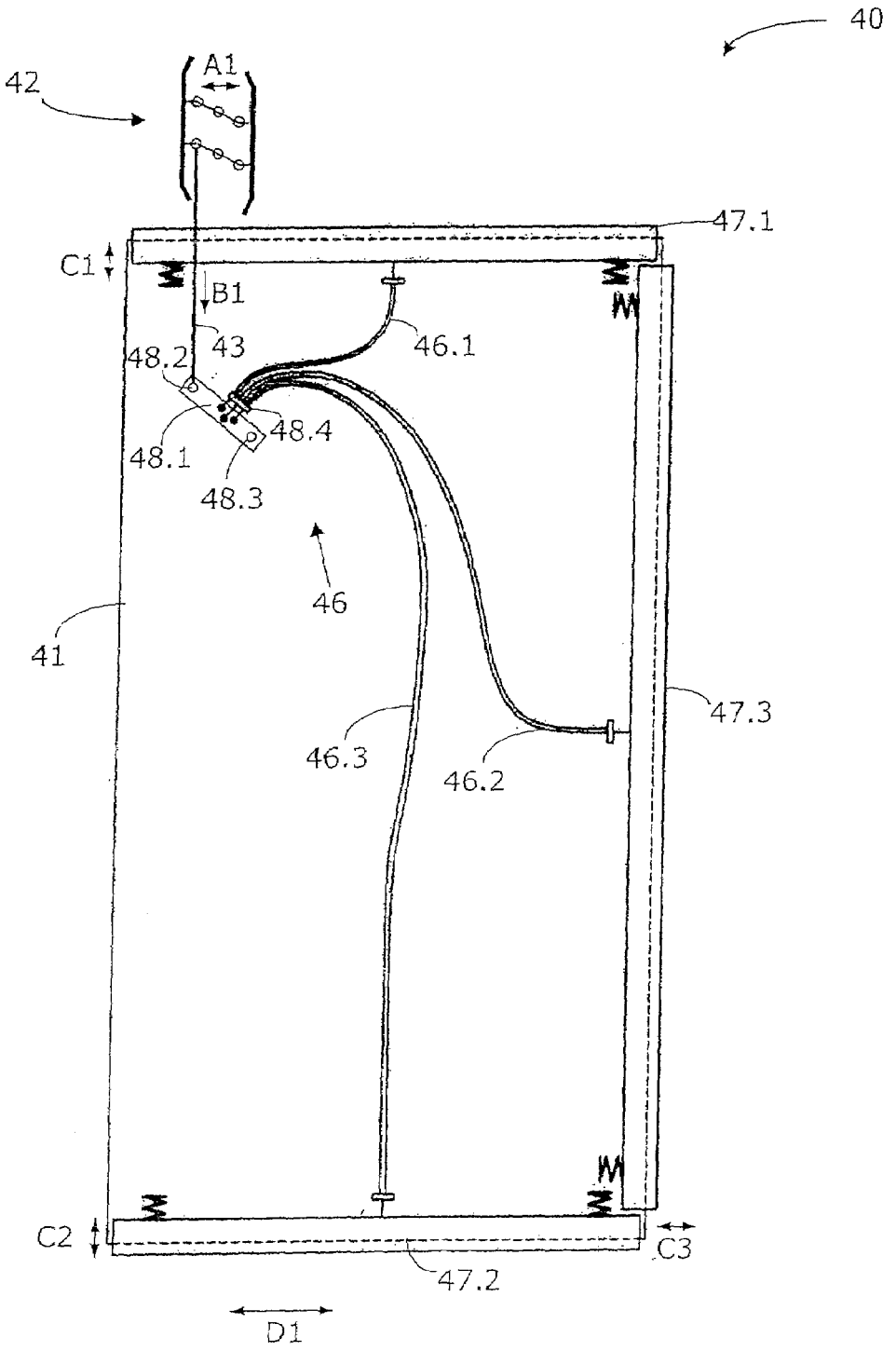
FIG. 5 shows a car door panel, according to the invention, which comprises an entrainer unit, a fifth coupling mechanism constructed in the manner of a Bowden pull and three movable seals.

FIG. 5 shows a fifth device 40 according to the invention in a schematic side view. The device 40 comprises three movable door seals 47.1, 47.2 and 47.3, which are carried by a horizontally slidable door panel 41. The movable door seals 47.1, 47.2 and 47.3 are so arranged that the door panel 41 in the closed state is sealed off relative to corresponding sealing surfaces (not shown in FIG. 5) at the elevator car by the door seals 47.1, 47.2 and 47.3 at least in a region. The device 40 comprises an entrainer element 42, which is fastened above the door panel 41 to the plate of a carriage carrying the door panel. This entrainer unit 42 comprises, for example, two runners which extend parallel to one another and are connected by way of a lever system. On stopping of the elevator car at the level of a floor and before opening of the door panel 41, the entrainer unit 42 makes a first (spreading) movement. This movement is termed the part movement A1. The part movement A1 is produced by a rotation of the lever of the lever system, which is moved by a car door drive or by a drive unit specially present for that purpose.

According to the present invention the device 40 comprises a coupling mechanism 46, which mechanically connects the entrainer unit 42 with the door seals 47.1, 47.2 and 47.3. In the illustrated example of embodiment the coupling mechanism 46 is a mechanism which is constructed like a Bowden pull and which is connected by way of a rod 43 or a lever with the lever system of the entrainer unit 42. The rod 43 executes, caused by the part movement A1, the downward movement B1. The rod 43 is connected with a lever arm 48.1 at a point 48.2. The lever arm 48.1 is mounted to be rotatable about an axle 48.3 and the ends of three Bowden pulls 46.1 to 46.3 are fastened to the lever arm 48.1. The casings of the three Bowden pulls 46.1 to 46.3 are held in a holder 48.4. The Bowden pull 46.1 is mechanically connected with the upper door seal 47.1, the Bowden pull 46.2 is mechanically connected with the lateral door seal 47.3 and the Bowden pull 46.3 is mechanically connected with the lower door seal 47.2. On movement apart (part movement A1) of the runners of the entrainer unit 42 the rods 43 are pushed downwardly. The lever arm 48.1 thereby rotates in a counter-clockwise sense about the axle 48.3 and a tension force is exerted on the Bowden pulls 46.1, 46.2, 46.3.

The upper seal 47.1 thereby moves downwardly, the lateral seal 47.3 to the left and the lower seal 47.2 upwardly. The movement of each of the seals 47.1, 47.2 and 47.3 is indicated by the arrows C1, C2 and C3 respectively. All three seals 47.1, 47.2 and 47.3 execute translational movements and are correspondingly mounted and guided. Springs, which are indicated only schematically in FIG. 5, are provided at each seal 47.1, 47.2 and 47.3. Parallel sliding guides, for example, are suitable for guidance of the seals 47.1, 47.2, 47.3.

Figures 6A, 6B, 6C, 6D:
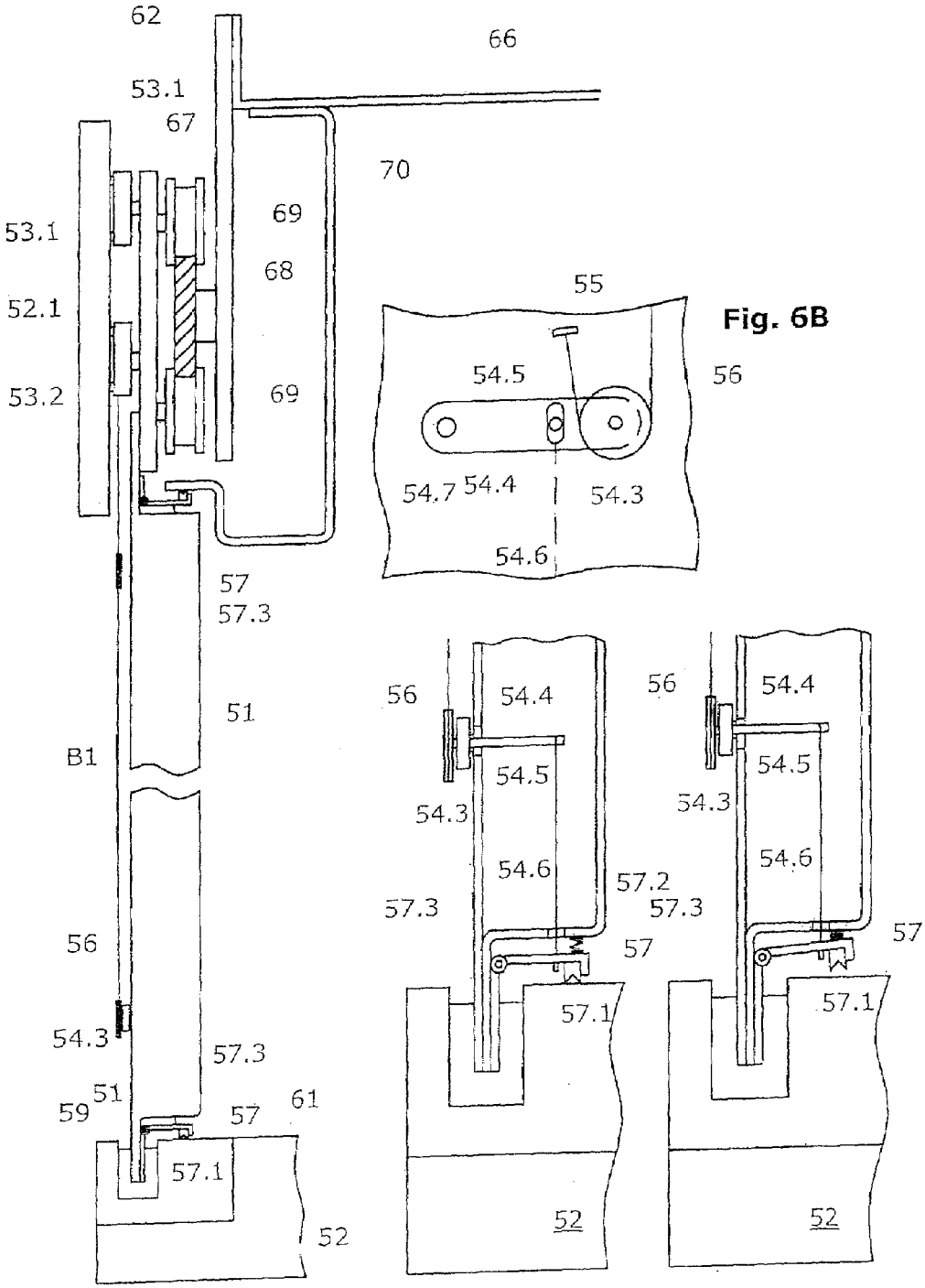
FIG. 6A is a schematic sectional view of a sixth coupling embodiment with two movable seals, according to the present invention, wherein the seals are disposed in a sealing position.
FIG. 6B shows a detail of the sixth coupling mechanism of FIG. 6A.
FIG. 6C shows a detail of the lower seal of the sixth coupling mechanism of FIG. 6A wherein the seal is disposed in a sealing position.
FIG. 6D shows a detail of the lower seal of the sixth coupling mechanism of FIG. 6A wherein the seal is disposed in an open position.

A further form of embodiment of the invention is illustrated in FIGS. 6A to 6D. In FIGS. 6A, 6C and 6D there are shown sections through the door front of an elevator car. A car door panel 51 can be recognized in FIG. 6A. The car door panel 51 has a carriage which comprises a plate 67 with rollers 69. This carriage moves along a rail 68 which is mechanically fastened to the elevator car 66. This suspension enables a horizontal opening and closing movement of the car door panel 51 in a plane perpendicular to the plane of the drawing. The car door panel 51 is guided at the lower end in a recess 59 in a car floor 52. A respective movable door seal 57 is arranged at the top and bottom on the righthand side of the car door panel 51 (i.e. on the car inner side). The door seals 57 are connected with the panel 51 by way of axles 57.3. The door seal 57 comprises a seal carrier 57.2 which carries a sealing profile 57.1. The door seal 57 is so arranged that the car door panel 51 in the closed state is sealed off with respect to a sealing surface 61 by the door seal 57 at least in a region.

The device comprises an entrainer unit 62 which is fastened to the plate 67 of the door panel 51. This entrainer unit 62 comprises, for example, two runners which extend parallel to one another and of which only one runner 52.1 is to be seen in FIG. 6A. The runners are connected together by way of a lever system 53.1, 53.2. There is provided a coupling mechanism constructed in the manner of a cable pull (similarly as in FIGS. 1 to 3B). The coupling mechanism comprises a cable 56 which is connected with a lever 53.2. The cable 56 executes, caused by the part movement A1 of the lever system 53.1, 53.2, the movement B1. The cable 56 is guided by way of a deflecting roller 54.3 and fixed to the panel 51 at a point 55. Since the seals 57 are disposed on the door inner side, a movement through-passage has to be provided at the door 51. The example of such a through-passage is illustrated in FIG. 6B. The deflecting roller 54.3 is connected with a pivot lever 54.4 which can rotate about an axle 54.7. An arm 54.5, which projects through a slot into the interior of the panel 51 and is connected at its end by means of an element similar to a rod or by means of a cable 54.6 with the movable door seal 57, is fastened to the pivot lever 54.4. If the cable 56 is pulled, then the righthand side of the pivot lever 54.4 (FIG. 6B) moves in counter-clockwise sense about the axle 54.7. The element 54.6 similar to a rod is thereby pulled by way of the arm 54.5 and the door seal 57 is thereby lifted off its sealing surface. The upper seal 57 is moved by virtually identical means, wherein—in similar manner to the illustration in FIG. 1—a further deflecting roller is actuated by the same cable 56.

A detail of the movement through-passage and the lower seal 57 is shown in FIGS. 6C and 6D. In FIG. 6C the lower seal 57 is disposed in the sealing position. The sealing profile 57.1 is seated on the sealing surface 61, since the element 54.6 similar to a rod does not exert any tension force or exerts only a small tension force. If now the cable 56 is pulled, then the element 54.6 similar to a rod moves the seal 57 upwardly, as illustrated in FIG. 6D. This position is termed the open position. In the open position there is no longer any contact between the sealing profile 57.1 and the sealing surface 61 of the car floor 52.

In the upper door region of the car door panel the seal 57 can be pressed against a visible crossbar 70 or another sealing surface at the housing of the elevator car 66 (see FIG. 6A).

Figure 7:
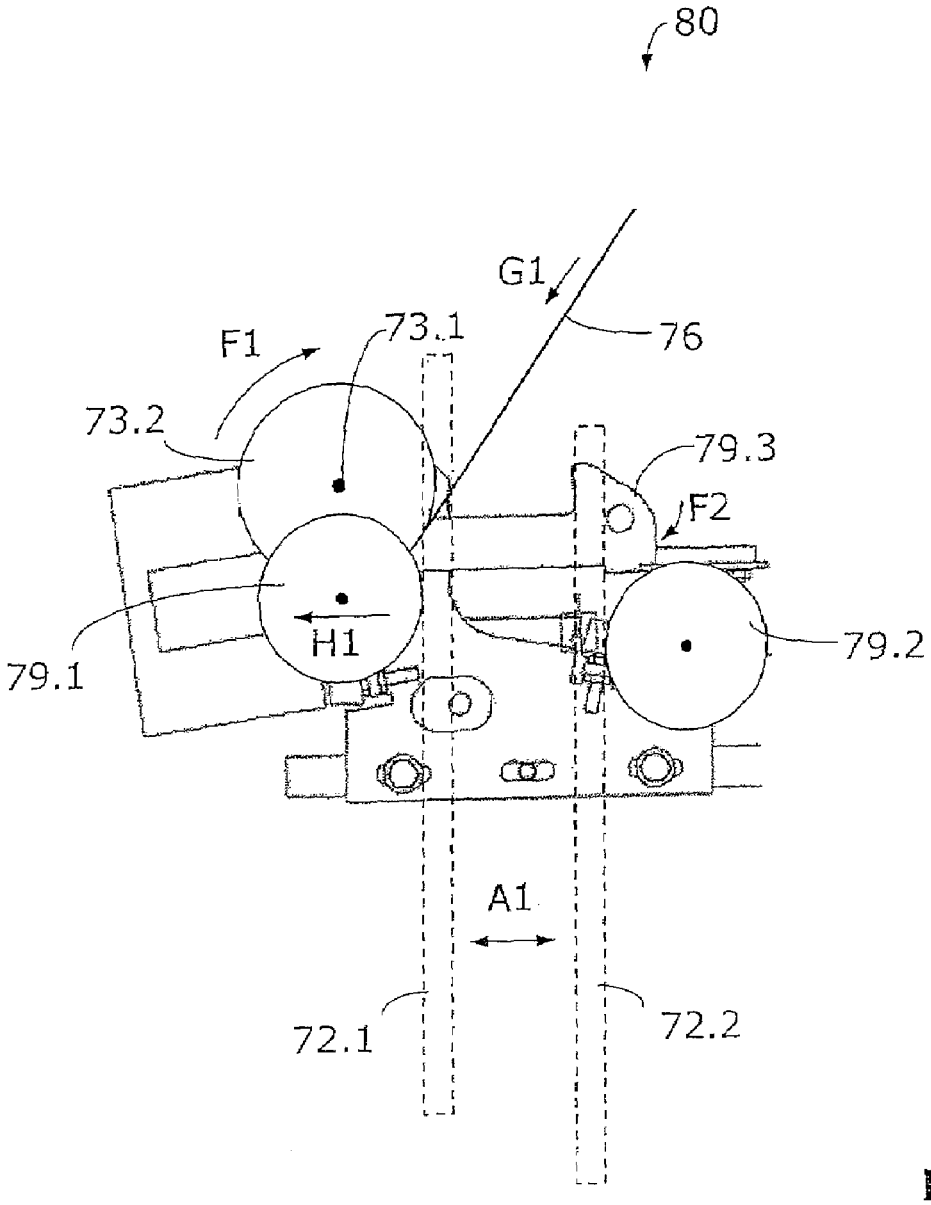
FIG. 7 is a schematic view of a seventh coupling mechanism, according to the present invention, wherein this coupling mechanism is disposed at a shaft door panel and constructed for the purpose of moving the seal of the shaft door panel.

A further form of embodiment is described with reference to FIG. 7. This form of embodiment differs from the previously described in that it circumvents movement of seals at a shaft door panel. As described, shaft door panels have shaft door rollers 79.1, 79.2, which form parts of an unlocking device 80 shown in FIG. 7. These shaft door rollers 79.1, 79.2 mechanically interact with the runners 72.1, 72.2 of an entrainer unit, which is seated at the car door panel, on opening of the car and shaft door panels. The runners 72.1, 72.2 are moved apart (part movement A1) and pass into the contact region of the shaft door rollers 79.1, 79.2. The shaft door roller 79.1 is fastened on a shaft door lock 79.3, which is connected with the shaft door panel by way of a rotational axle 73.1, and is displaceable to the left about the rotational axle 73.1 of the shaft door lock 79.3 with respect to the shaft door panel and the shaft door roller 79.2, which is fastened thereto to be non-displaceable. Through the interaction between the runners 72.1, 72.2 and the shaft door rollers 79.1, 79.2 the shaft door lock 79.3 is pivoted in clockwise sense about its rotational axle 73.1 and unlocked. After the unlocking, the runners 72.1, 72.2 execute a common horizontal movement, which here is termed opening movement. Through this opening movement, the car door panel opens the panels of the shaft door.

In order to be able to bring the movable seals of the shaft door from the sealing position into the open position, according to the invention a coupling mechanism is provided which mechanically connects the entrainer unit with the door seals. In the example shown in FIG. 7, the coupling mechanism comprises a roller 73.2 which is rigidly connected with the shaft door lock 79.3, wherein its center lies on the rotational axle 73.1 thereof. This has the consequence that the roller 73.2 in common with the shaft door lock 79.3 pivots in clockwise sense about the rotational axle 73.1 (indicated by an arrow F1) when the shaft roller 79.1—driven by the part movement A1 of the runners 72.1, 72.2—executes a movement (indicated by an arrow H1) to the left. Through the movement F1, a cable 76 is pulled by the roller 73.2. This pulling movement (indicated by an arrow G1) can, as explained in conjunction with the preceding examples of examples of embodiment, be converted into a movement of one or more seals.

This form of embodiment can also comprise, instead of a coupling mechanism constructed like a cable pull, a coupling mechanism, which is constructed like a Bowden pull, or a lever mechanism.

The described forms of embodiment can be modified in different mode and manner. There can also be realized forms of embodiment in which not only the car door panels, but also the shaft door panels are provided with movable seals.

Instead of using the entrainer unit 35 with the integrated scanning runners 32.4, 32.5 (see FIG. 4), in the case of the device 30 there can also be used, for example, simple runners as shown in FIGS. 1 to 3A. The coupling mechanism, similar to a cable pull, of FIGS. 1 to 3B and FIGS. 6A to 6C can be of different construction by another arrangement of the individual elements (cables, rollers, levers and movement through-passage). In addition, several cable sections can be used instead of a single cable. Instead of the cable there can also be used another flexible element which is suitable for the purpose of transmitting a force from the entrainer unit to the seal.

Instead of using a system similar to a Bowden pull or a cable pull, the coupling mechanism can be constructed as a lever system, wherein a tension force can be exerted on the door seal by way of the lever system.

The seals can be so designed that they execute a translational, a rotational or a combined translational and rotational movement.

The seal carriers can be constructed as, for example, a folding element, a tipping element or as a slide, preferably with a parallel guidance system.

The sealing profile can be optimized in correspondence with the respective use. For example, materials can be used which are not suitable for rubbing seals. Soft rubber mixtures or rubber-like foam materials, for example, are particularly suitable. It is also possible to admix magnetic particles with the material of the sealing profile. If a metal strip or the like is then brought against the sealing surface, a magnetic attractive force then results between the sealing profile and the sealing surface. The sealing effect can thereby be further improved.

In certain circumstances it can happen that one of the seals or the coupling mechanism jams. It can also come about that one of the moved elements is difficult to move. In order to prevent a mechanical reaction on the entrainer unit, there can be used an optional means which, on exceeding of a predetermined force, produces a separation of the means. As one possibility there is mentioned a slipping clutch which, for example, can be fastened to the roller 14.1 or integrated in the roller 14.1.

Depending on the respective arrangement of the seals, the interior space of the elevator car can be completed sealed off.

The part movement A1 used for opening the seal or seals can, for example, be the same movement which is used for unlocking the car doors and/or the shaft doors. Also applicable as the part movement A1 can be a setting movement which is executed in order to bring a running unit into connection with shaft door rollers.

According to the present invention the device is mechanically connected with the door panel and moves in common therewith on opening and closing of the door panel.

Preferably, restoring elements are provided at the movable door seals in order to guide the seals by themselves back into the sealing position as soon as a force is no longer exerted on the seals by way of the coupling mechanism.

The present invention is particularly suitable for high-speed elevators and for elevators which have to be specially sealed off.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator door system, comprising:

a car door panel and at least one shaft door panel;

an entrainer unit connected with said car door panel and forming an engageable linkage between said car door panel and said at least one shaft door panel;

a door panel seal movably mounted on a door panel, said door panel being at least one of said car door panel and said at least one shaft door panel; and a coupling mechanism mechanically connected between said entrainer unit and said door panel seal for bringing said door panel seal from a sealing position into an open position and vice versa.

2. The system according to claim 1 wherein said coupling mechanism converts movement of said entrainer unit into at least one of a sliding movement and a rotational movement of said door panel seal.

3. The system according to claim 1 wherein said door panel seal is in the sealing position when said door panel is closed, wherein said door panel seal in the sealing position seals off said door panel relative to a sealing surface disposed at an elevator car or at a shaft door frame.

4. The system according to claim 1 wherein said door panel seal includes at least two movable door seals each of which is brought by said coupling mechanism out of the sealing position into the open position in order to seal off an interior space of an elevator car.

5. The system according to claim 1 wherein said entrainer unit and said coupling mechanism are mechanically connected with said door panel and move in fixed relationship thereto on opening and closing of said door panel.

6. The system according to claim 1 wherein said entrainer unit and said coupling mechanism move said door panel seal to the open position whereby said door panel seal is movable free of contact along a sealing surface.

7. The system according to claim 1 wherein said coupling mechanism includes spring means for bringing said door panel seal back to the sealing position as soon as said door panel is closed.

8. The system according to claim 1 wherein said coupling mechanism includes at least one deflecting roller and a cable extending over said at least one deflecting roller and being connected to said door panel seal wherein a tension force can be exerted on said door panel seal by said coupling mechanism pulling said cable.

9. The system according to claim 1 wherein said coupling mechanism includes a Bowden pull connected to said door panel seal wherein a tension force is exerted on said door panel seal by said Bowden pull.

10. The system according to claim 1 wherein said coupling mechanism includes a lever system connected to said door panel seal wherein a tension force is exerted on said door panel seal by said lever system.

11. The system according to claim 1 wherein said door panel seal includes a seal carrier with a sealing profile, said seal cater being mounted for one of translational movement and rotational movement to bring said sealing profile into the sealing position.

* * * * *